United States Patent [19]

Galerne

[11] 4,227,524

[45] Oct. 14, 1980

[54] HYPERBARIC TRANSFER SYSTEM

[76] Inventor: Andre Galerne, 4 Cedar Island, Larchmont, N.Y. 10538

[21] Appl. No.: 892,867

[22] Filed: Apr. 3, 1978

[51] Int. Cl.[3] ..... B63C 11/32

[52] U.S. Cl. ..... 128/205.26

[58] Field of Search ..... 128/204, 142 R, 142 G, 128/142.2, 142.3, 142.4, 142.5, 142.7, 298; 98/1.5; 405/185, 186, 192, 193

[56] References Cited

U.S. PATENT DOCUMENTS

| | | | |
|---|---|---|---|
| 2,448,546 | 9/1948 | Plemel et al. | 128/204 |
| 3,323,312 | 6/1967 | Banjavich | 405/193 |
| 3,358,683 | 12/1967 | Goiten | 128/204 |
| 3,587,574 | 6/1971 | Mercer | 128/204 |
| 3,754,551 | 8/1973 | Nielsen | 128/204 |
| 3,877,427 | 4/1975 | Alexeev et al. | 128/204 |
| 4,011,867 | 3/1977 | Arntzen | 128/204 |
| 4,106,504 | 8/1978 | York | 128/204 |

FOREIGN PATENT DOCUMENTS

| | | | |
|---|---|---|---|
| 567450 | 11/1974 | U.S.S.R. | 128/204 |

OTHER PUBLICATIONS

Feder (Associate Editor), "Offshore", May, 1975.

*Primary Examiner*—Henry J. Recla
*Attorney, Agent, or Firm*—William F. Lawrence

[57] ABSTRACT

A hyperbaric transfer system which has particular utility in transporting injured divers under high pressure from an offshore decompression chamber to an onshore decompression chamber complex. In its preferred form the system includes two chambers. The first chamber is a smaller transfer vessel capable of accomodating up to two individuals. The second chamber is a larger chamber capable cf accomodating more than three and up to eight individuals. One of the individuals in the second chamber may be a medical attendant who can administer aid to an injured individual. Both chambers are capable of maintaining pressures of up to 335 psi, equivalent to a depth of about 750 feet.

22 Claims, 10 Drawing Figures

HYPERBARIC TRANSFER SYSTEM

BACKGROUND OF THE INVENTION

The invention relates to a hyperbaric transfer system for transferring individuals under high pressure conditions. Preferably, the system is used in transferring divers undergoing decompression from an offshore decompression chamber to an onshore hyperbaric facility.

Offshore diving operations have brought tremendous problems to divers who are called upon to perform heavy construction work at depths and in diving conditions that border on the limits of underwater technology. The risk of serious trauma exists and with the use of saturation techniques there is the danger of acute illness while a diver is under pressure.

Divers who have worked at great depths for considerable amounts of time must undergo decompression for periods up to two weeks. Normally, the decompression process takes place in a conventional decompression chamber on the offshore rig. However, in certain emergency situations it may become necessary or desireable for the diver undergoing decompression to leave the offshore rig.

One such instance is during rig abandonment situations, such as a blow out, fire or collision. Under current practice in such a situation divers remain in the decompression chamber on the rig or the decompression chamber is jettisoned into the water. In some instances, the divers are transferred to a diving bell which is lowered into the sea. However, these practices are not reliable, safe or efficient.

Leaving the decompression chamber on the offshore rig is unsafe since the divers in the chambers are helpless and cannot protect themselves from the danger of the emergency situation. However, the alternative of transferring the occupants to a diving bell or jettisoning the chamber into the sea is even less desireable. The process is slow and dangerous. Since it is so dangerous, this step cannot be taken as a conservative course of action to provide a maximum amount of safety for the divers even though there is no immediate danger. Therefore, this step is taken only when it is clear that the rig will be lost. In jettisoning the chamber or placing the diving bell in the sea, the guidelines securing the chamber or bell to the rig are cut and the divers must rely on a later attempt to retrieve them by a supply or rescue ship. However, recovery is contingent on the availability of a rescue ship, weather conditions, sea conditions, as well as containment of the original emergency which caused the rig abandonment.

Another instance in which it would be desireable to leave the offshore rig is if a diver has been seriously injured and needs medical care. Until now the injured diver has received treatment on the offshore rig. However, treatment is often unsatisfactory. A doctor has to be located and transported to the offshore rig. Once the doctor arrives, the equipment to properly treat the patient is not always available on the rig. If the patient needs an operation, the conditions, facilities and equipment on an offshore rig do not compare with an onshore hospital. Inherent in an offshore decompression chamber are excessive noise and vibration levels, possibly poor communications and lighting, the absence of immediate specialist treatment facilities and greater risk of infection. If hospitalization is required, the diver must wait until the normal decompression schedule is complete so he can be transferred to an onshore hospital.

Although the diver's safety is of utmost importance, economic considerations are also present. If the decompression chamber of an off-shore rig is tied up for days while in use in an attempt to save a diver's life, the decompression chamber is unavailable for normal operations. If rig operations are held up, expenses for such an immobilization could average $50,000 per day.

SUMMARY

The present invention, which relates to a unique system that allows the transfer of divers under continuous pressure from an offshore decompression chamber to an onshore hyperbaric facility, solves these problems. In an emergency situation, the transfer system can simultaneously transport more than three individuals to an onshore decompression facility such as the North Sea Hyperbaric Center in Dundee, Scotland. Once there, the patients can be attended to by doctors in well lit, noise free and vibration free surroundings.

One general object of this invention, therefore, is to provide a new and improved system for transporting individuals under high pressure conditions.

More specifically, an object of this invention is to provide a system which is capable of transporting at least three individuals simultaneously under high pressure.

Another object of the invention is to provide a system for transporting an injured individual under high pressure in a safe, fast and reliable manner to a hyperbaric treatment center.

A further object of the invention is to provide a system for maintaining individuals under high pressure which is capable of being moved easily in restricted surroundings.

An additional object of the invention is to provide a system which is lightweight and capable of being transported by helicopter.

A still further object of the invention is to provide a system which can maintain life support systems for an individual under high pressure and which is still a portable system.

In one illustrative embodiment of the invention, the system includes two chambers. The first chamber is lightweight and capable of receiving a plurality of individuals at a time. The first chamber, called a transfer chamber, is mated with a conventional decompression chamber and pressurized. Up to two individuals are transferred to the transfer chamber which is sealed. The transfer chamber is then mated with a larger second chamber called a helicopter chamber. An attendant already in the helicopter chamber, which is also pressurized, assists the individuals into the helicopter chamber. This procedure is repeated until the helicopter chamber is full. The helicopter chamber is then transported, by helicopter or another expedient means, to a hyperbaric facility.

In another illustrative embodiment of the invention, the helicopter chamber is mated directly to a conventional decompression chamber. The helicopter chamber accomodates at least three individuals. The helicopter chamber is then transported to another hyperbaric facility with which the helicopter chamber can be mated. The individuals in the helicopter chamber are then transferred to the hyperbaric facility.

In accordance with one feature of the invention, in several particular important arrangements, the interior of the transfer chamber is provided with a removable elliptical access hatch which is capable of being closed from either the inside or outside of the chamber. With this arrangement, the hatch may be readily removed from the chamber by orienting its smaller dimension in juxtaposition with the long dimension of the opening and then withdrawing the hatch through the opening.

In accordance with a further feature of some of the embodiments of the invention, the helicopter chamber, while remaining portable, is provided with life support systems capable of sustaining at least three individuals under high pressure for long periods of time during transportation. The transfer chamber may also be provided with life support systems such as a compression gas and oxygen gas supply system, a stretcher and stretcher support system, or a communication system. The life support systems for the helicopter chamber include systems to remove carbon dioxide, to supply breathing gas, to supply supplementary oxygen to the breathing gas, to supply compression gas, to dehumidify the chamber, to analyze the oxygen and carbon dioxide content, to supply communications, to provide heat in amounts which can be regulated, to provide light or to permit the transfer of materials into and out of the chamber. These support systems accomodate not only a plurality of injured individuals but also a medical attendant when necessary to maintain the patients in a stable condition.

The foregoing and other objects, features, and advantages of the invention will be more readily understood from the following description of certain preferred embodiments when read with the accompanying drawings.

DETAILED DESCRIPTION OF CERTAIN PREFERRED EMBODIMENTS

Figure 1:
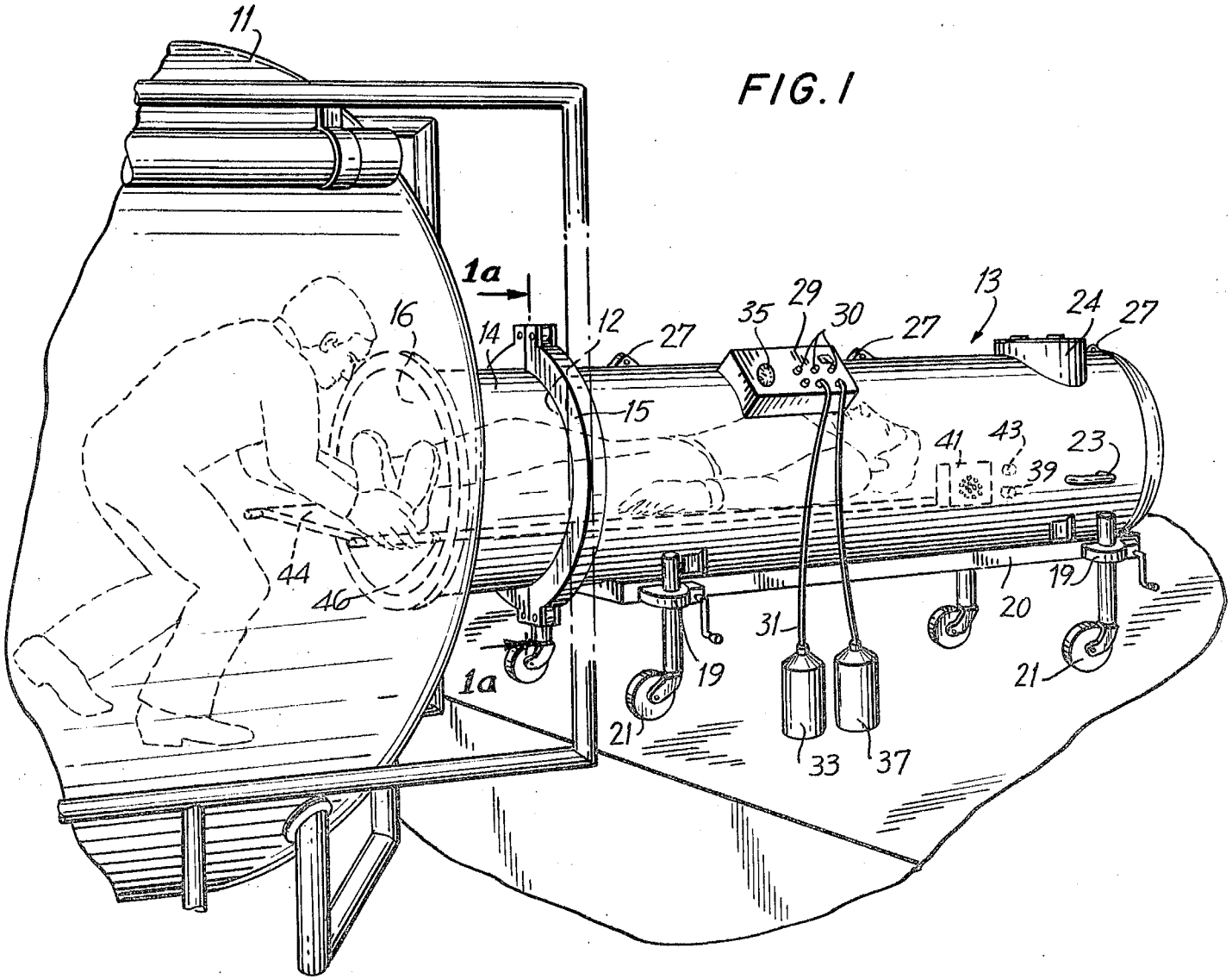
FIG. 1 is a perspective view of an injured diver being maintained under pressure while being transferred from an offshore decompression chamber into the transfer vessel.
Figure 1C:
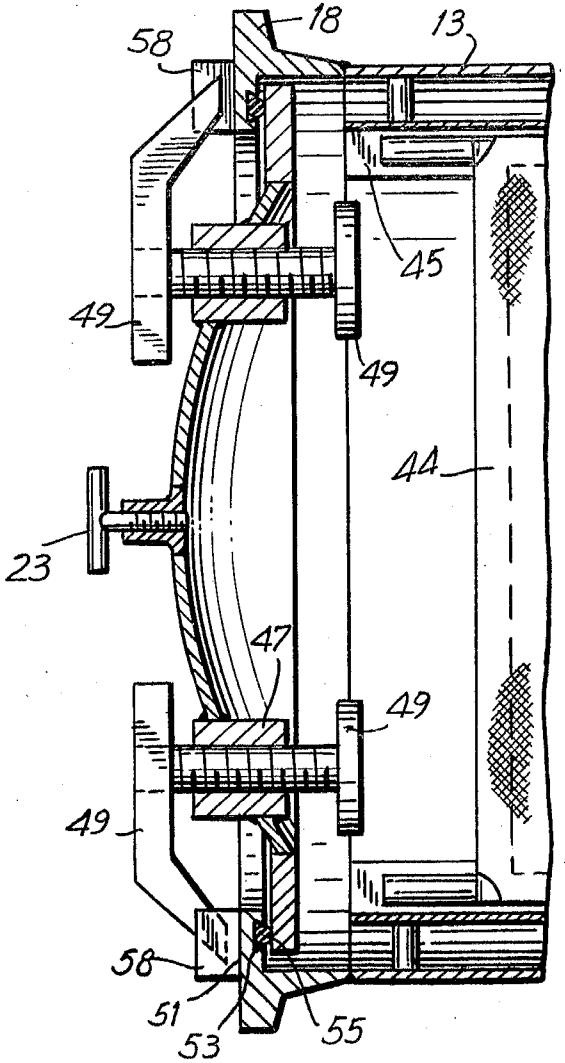
FIG. 1*c* is a cross-sectional side view of part of the transfer chamber and the access hatch along the lines 1*c*—1*c* in FIG. 1*b*.
Figure 1A:
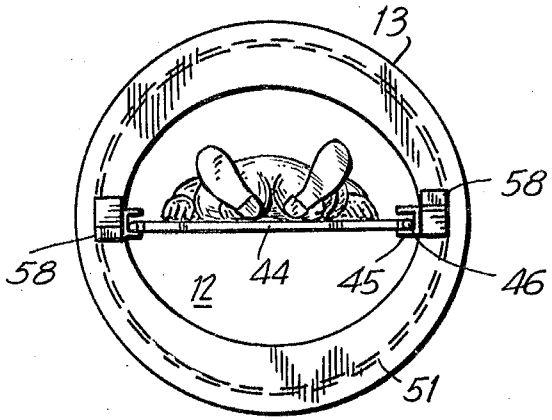
FIG. 1*a* is a cross-sectional view of the transfer chamber along the lines 1*a*—1*a* in FIG. 1.

Referring to FIGS. 1 and 1*a*, there is shown an injured diver being transferred from a conventional decompression chamber 11 to a transfer vessel 13. The decompression chamber 13 is generally spherical in shape and has a short tubular projection 14 which defines a doorway 16. The outer end of projection 14 is provided with a flange which has a flat outer surface to allow it to be mated with the flange 18 (shown in FIG. 1*c*) of the transfer vessel 13. The flanges of the transfer vessel 13 and the decompression chamber 11 are not visible since they are obscured by the annular shaped clamp-type coupling 15.

The transfer vessel 13 is generally cylindrical in shape with a longitudinal horizontal axis and an access hatch opening 12. The vessel 13 is removeably mounted on a rectangular base 20. The base 20 is provided with four independent adjustable vertical screw jacks 19 on each corner of the base 20 with casters 21 mounted on the foot of each screw jack. The transfer vessel 13 has a circular viewing porthole 24 in the upper half of the vessel 13 at the end opposite the access opening 12. The outside surface of the transfer vessel 13 is also provided with eight handles 23 (although for the sake of clarity only one is shown), three on each side of the vessel, one on the closed end of the vessel and one on the outside of the surface access hatch 25. On the top of the outside surface of the vessel 13 are three lifting eyes 27 spaced longitudinally in a straight line. The middle eyelet is positioned at the center of gravity of the vessel. Welded to the outside surface of the vessel is a metal box 29. Recessed within openings in the box 29 are a group of hull penetrators 30 for gas and electrical connections, as well as any metering devices such as the depth pressure gauge 35 for the transfer vessel 13. Two of the hull penetrators 30 have fittings for attachment to hoses 31 which are attached to an oxygen supply 33 and a compressed gas supply 37. Another penetrator 30 contains a one way exhausting metering valve. Still another penetrator 30 allows electrical wiring to pass through the hull surface for attachment to an oxygen sensor 39, a communications system 41 and a small light bulb 43. The sensor 39, communications system 41 and bulb 43 are attached to the inside surface of the vessel 13.

As shown in FIG. 1*a*, a cross-sectional view of the transfer vessel along the lines 1*a*—1*a* in FIG. 1, the transfer vessel 13 is provided with channel shaped supports 45 along the length of each side of the vessel 13. A rectangular stretcher 44 having a tubular frame 46 around its edge is slidably mounted in the supports 45 of the vessel for movement through the hatch opening 12 which is elliptical in shape.

Figure 1B:
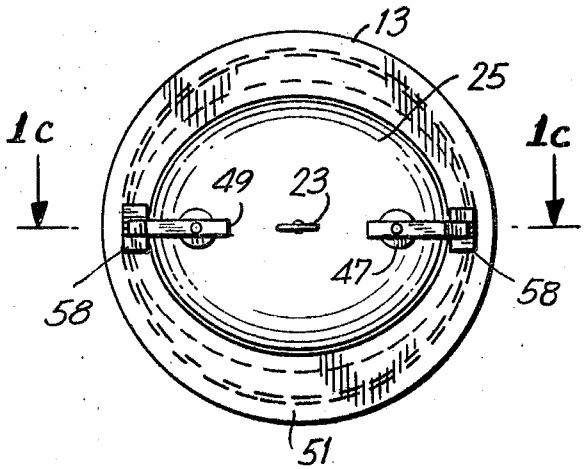
FIG. 1*b* is a cross-sectional view of the transfer chamber with the transfer chamber access hatch in place.

Referring to FIGS. 1*b* and 1*c*, front and side views of the hatch opening 12 and the hatch 25 are shown. The circumference of the hatch 25 is elliptical shaped as illustratedin FIG. 1*b*. As shown in FIG. 1*c*, the center portion of the hatch 25 is curved outwardly away from the transfer chamber opening and the outer portion of the hatch is flat, perpendicular to the longitudinal axis of the vessel 13. The hatch is provided with a handle 23 and has two threaded bosses 47 which pass through the hatch 25 on each side of the handle 23. Within each threaded boss and passing through the hatch is a shaft of a locking handle 49 which is T-shaped on both the inside and outside of the hatch 25. The shaft of the locking handle 49 is rotatable in the boss but is sealed with O-ring seals to prevent any pressure loss within the vessel 13. The inside circumference of the opening 12 has a ledge 51 with a groove 53 in which is mounted a torroidal shaped seal 55. The flange 18 of the vessel 13 has a flat outer surface 56 and a wedge shaped camming block 58 mounted on the flat surface of the flange 18. The camming wedge 58 is positioned near the inner diameter of the flange near the hatch opening and away from the outer diameter of the flange.

Figure 2:
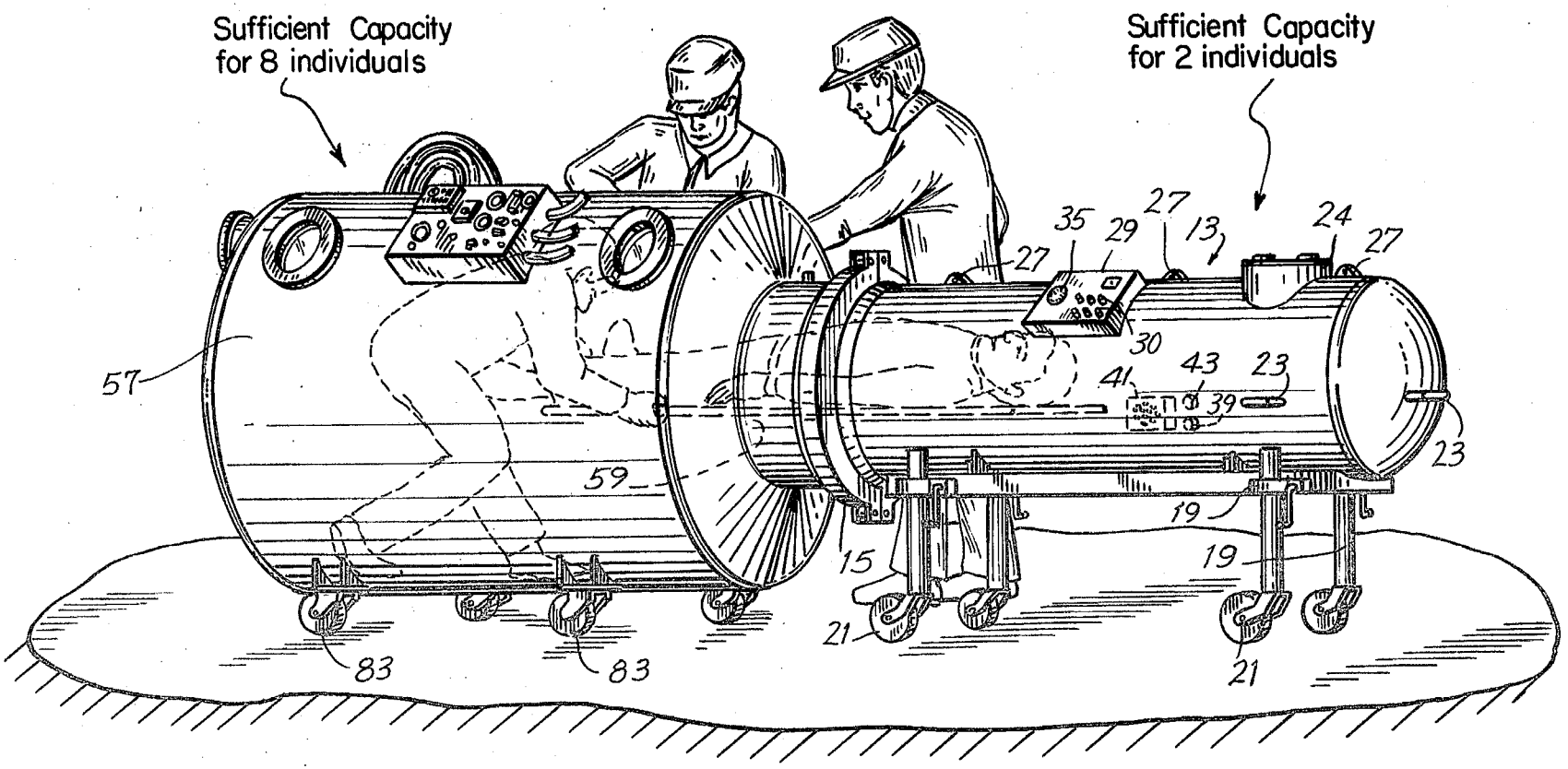
FIG. 2 is a perspective view of the transfer chamber mated with the helicopter chamber into which the diver is being transferred.
Figure 3:
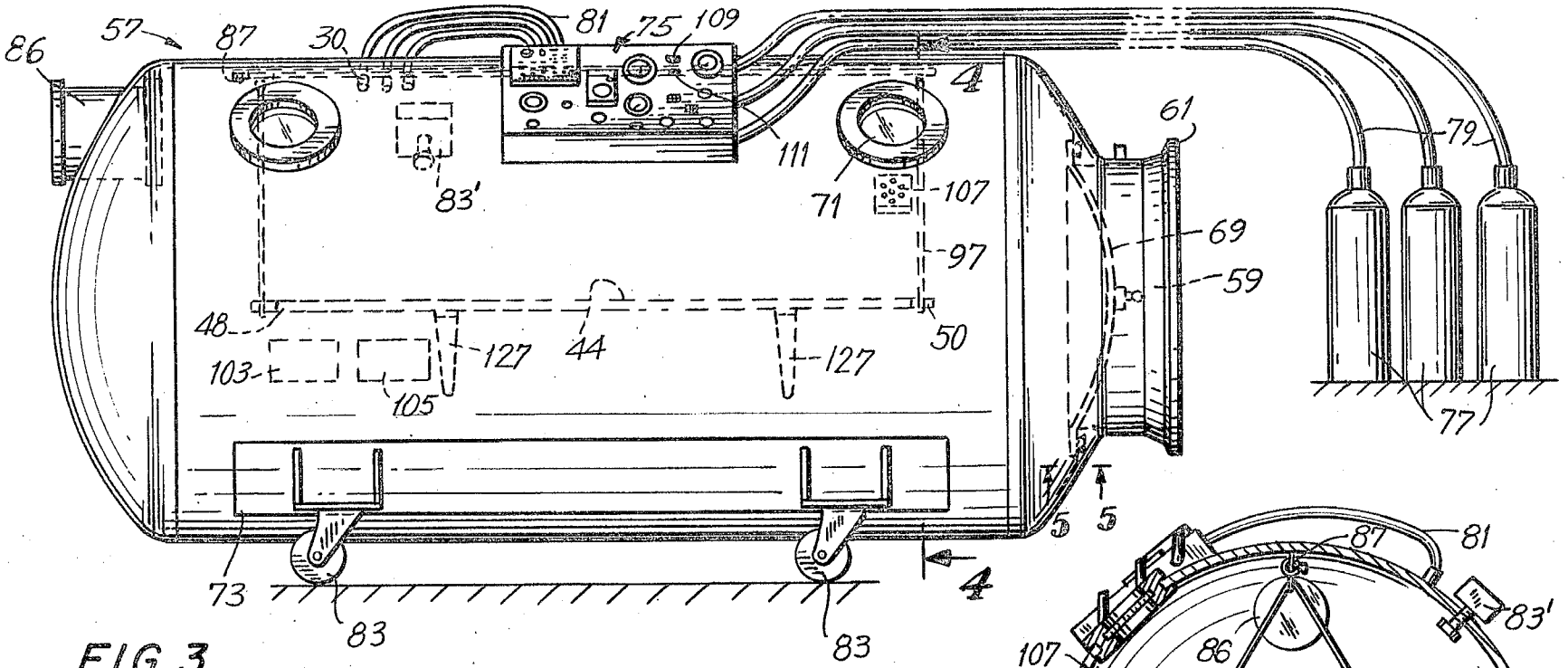
FIG. 3 is a side elevational view of the helicopter chamber.
Figure 5:
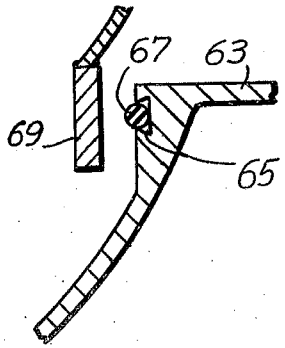
FIG. 5 is a fragmentary sectional view along the line 5—5 of FIG. 3.

Referring to FIG. 2, which shows the transfer chamber 13 mated with the helicopter chamber 57 and FIG. 3 which shows a cross-sectional view of the helicopter chamber 57, the helicopter chamber 57 is generally cylindrical in shape with a longitudinal horizontal axis and an access aperture 59 at one end of the chamber 57. Around the access aperture 59 is flanged rim 61. On the inside circumference of the aperture is a supporting ledge 63 having a slot 65 therein into which a second torroidal shaped seal 67 is mounted as shown in FIG. 5. The access door 69 is identical in structure to the hatch 25 except the access door 69 is circular shaped to cover the circular aperture 59. Like the access hatch 25, the inner portion of the access door is curved outwardly away from the access aperture and the outer portion is flat, perpendicular to the longitudinal access of the chamber 59. The helicopter chamber 57 is provided with two circular viewing windows 71 located in the upper portion of the chamber 57 at each end of the chamber so one looking in will look down into the chamber. The outside surface of the helicopter chamber 57 is also provided with eight rectangular heating strips 73 (only one has been shown for the sake of clarity in FIG. 3). Also on the outer surface of the chamber 57 is the main control panel 75 which contains the monitoring devices and control systems for the helicopter chamber. Three separate tanks 77 containing oxygen, breathing gas and compression gas for the chamber 57 are attached by hoses 79 to the control panel 75 where gas is metered and passed into the chamber 57 through hoses 81 attached to penetrators 30 located on the upper portion of the back side of the chamber. A compact fiber optic lighting system 83' is attached to the back side of the chamber below the penetrators 30. A medical lock 86 is provided in the rear of the chamber. The medical lock 86 is in the form of two cylinder shaped pieces each closed at one end. Both cylinders are threaded on the outside of the cylinder at the open end. The threaded ends are screwed into opposite sides of a threaded hole in the helicopter chamber. Each closed end of the cylindrical medical lock is provided with a pressure release ball valve. The helicopter chamber 57 is also provided with four wheels 83 attached to the bottom of the chamber 57.

Figure 4:
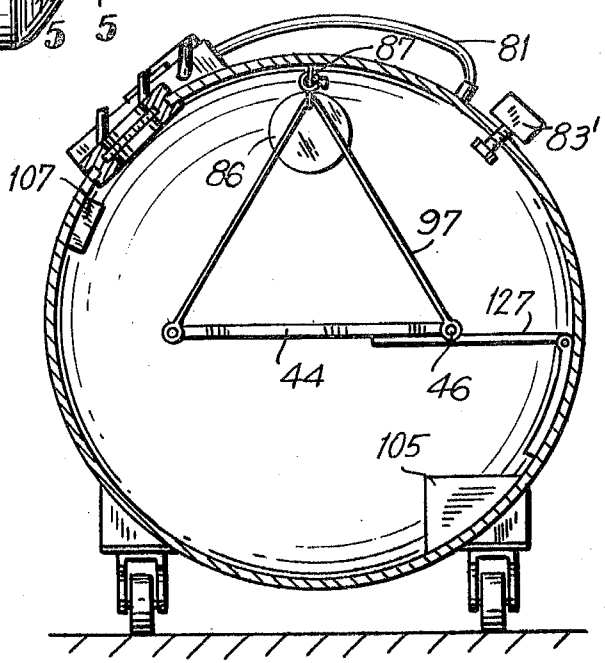
FIG. 4 is a cross-sectional view of the helicopter chamber along the line 4—4 in FIG. 3.
Figure 6:
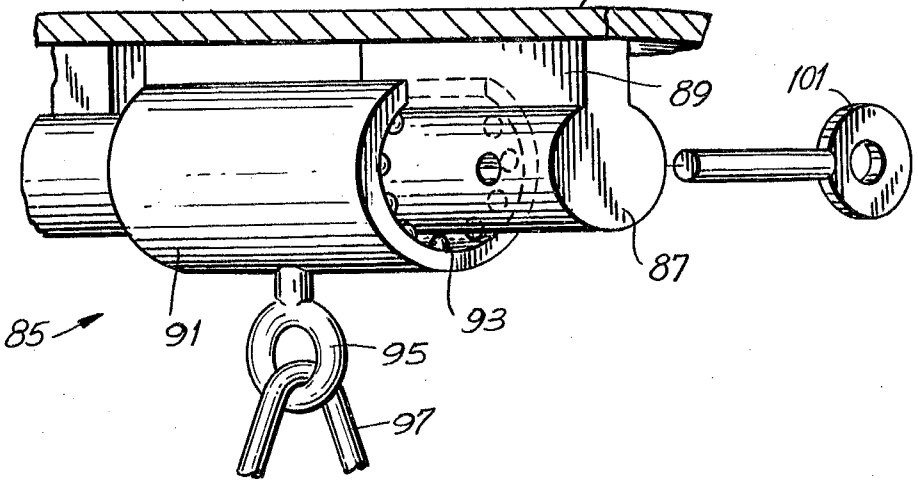
FIG. 6 is a front perspective view of the race ball bearing system for the system.

Referring to FIGS. 3, 4 and 6, inside the helicopter chamber 57, a linear race ball bearing system 85, as illustrated in FIGS. 3 and 6, supports the stretcher 44. A solid cylindrical rail 87 is mounted longitudinally along the length of the ceiling of the chamber 57. A U-shaped bearing cup 91 having within it a U-shaped linear bearing race 93 fits snugly around the rail 87 and slides longitudinally along the length of the rail. A ring 95 is attached to the bottom of the cup 93. A wire 97 is passed through the hole in the ring 95 and each of the two ends of the wire are attached to each corner of the frame 46 at the head 48 of the stretcher 44. A second bearing cup and bearing race are mounted on the rail 87. The second bearing cup also has a ring through which a wire is passed. The two ends of the wire are attached to each corner of the foot 50 of the stretcher 44. A disconnect pin 101 passes through a hole 99 in each end of the rail 85. The disconnect pin 101 is ring shaped with a tubular projection which fits into hole 99. The stretcher 44 is also held in place by brackets 127 pivotally mounted underneath the stretcher on the wall of the chamber 57. Underneath the stretcher 44 and against the wall of the chamber 57, is located a system for removing carbon dioxide 103 from the chamber and a dehumidification system 105. Also inside the chamber 57, mounted on a wall is a communication system 107 which is connected to a mating system outside the chamber through the control box 75. Also through the control box 75, the chamber is provided with systems for analyzing the oxygen content 109 and carbon dioxide content 111 of the gas within the helicopter chamber 57.

Figure 7:
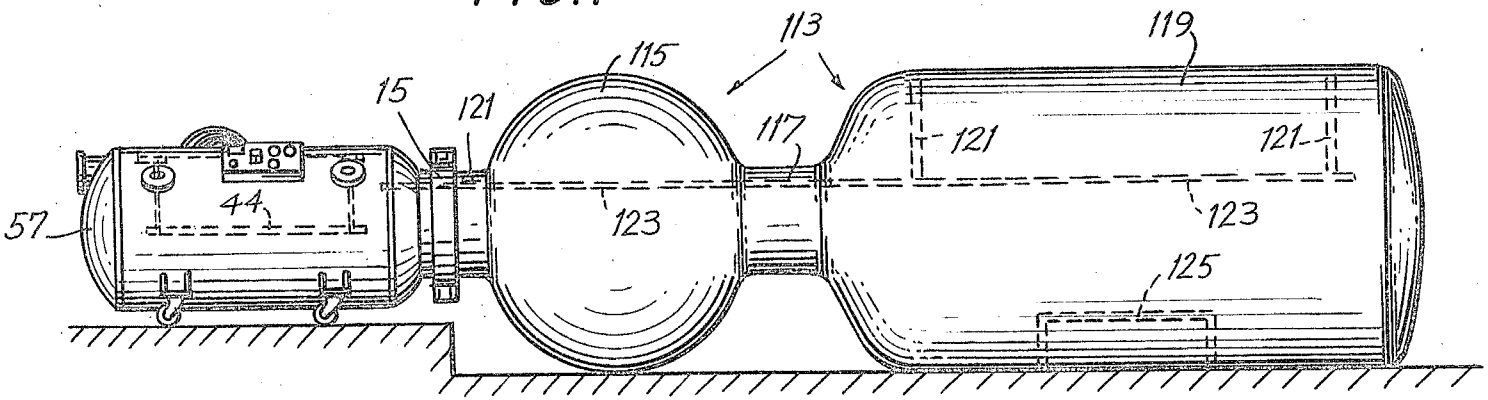
FIG. 7 is a side elevational view of the transfer chamber mated with the onshore hyperbaric facility.

Referring to FIG. 7, the helicopter chamber 57 is shown mated with an onshore hyperbaric facility 113.

The helicopter chamber 57 having the stretcher 44 hanging therein on the linear race ball bearing system 85 is mated with the entry lock 115 of the onshore hyperbaric facility. The annular clamp-type coupling 15 seals the helicopter chamber 57 and the entry lock 115. At one end of the entry lock 115 which is generally spherical in shape is a flange with a circular opening (not visible in FIG. 7) which mates with the flanged rim 61 and aperture 59 of the helicopter chamber 57. The other end of the entry lock 115 has a cylindrical passageway 117 which mates the entry lock 115 with the main lock 119 of the hyperbaric facility 113. The main lock 119 is essentially cylindrical in shape and has a longitudinal axis. Attached to the ceiling of the main lock 119 are two supporting brackets 121. Another supporting bracket 121 is attached to the ceiling in the entry lock 115. The three supporting brackets 121 support a cylindrical rod 123 indentical in construction to rail 87. The rod 123 extends longitudinally from the rear of the main lock 119, through the passageway 117, through the entry lock 115, through the aperture 59 and into the helicopter chamber 57. Inside the main lock 119 is a treatment table 125.

In use, as shown in FIGS. 1 and 1*a*, an injured diver is transferred from a conventional decompression chamber 11 to a transfer vessel 13. The transfer vessel 13 is of sufficient capacity to accommodate two divers. Initially, the decompression chamber 11 is mated with the transfer vessel 13 by abutting their flanges (not visible in FIG. 1) and sealing them together with a standard clamp-type annular coupling 15. Illustratively, a 600 mm Industrial Standard Flange manufactured by Comex Diving Ltd., Marseilles, France, is used as a coupling 15. The transfer vessel 13 is pressurized to the same level as the decompression chamber 11 using the same system that supplies pressure to the decompression chamber 11. Optionally, the transfer vessel 13 can be pressurized by connecting the hose 31 of the compression gas supply 37 to the penetrator 30 and adding the gas to the vessel 13. The decompression chamber hatch (not visible in FIGS. 1 and 1*a*) and the transfer vessel's access hatch 25 (shown in FIGS. 1*b* and 1*c*) are removed, and the divers are transferred into the transfer chamber 13. The elliptical hatch 25 is especially advantageous since it permits the hatch 25 to be removed through the access hatch opening 12 out of the transfer vessel 13. This maximizes the space available to those entering the vessel 13 since the access hatch 25 is out of the way. By unlocking the hatch 25 and orienting the smaller dimension in a juxtaposition with the long dimension of the opening, the hatch 25 is withdrawn through the opening 12. The hatch 25 can also be locked and unlocked from either inside or outside the chamber. The hatch 25 is put into the transfer chamber 13 rotated into position and brought to bear against ledge 51 and seal 53. The T-shaped handles 49 are rotated from either inside or outside the vessel 13, camming the end of the outside handle against the wedge shaped camming block 58 and sealing the hatch 25 in place. To unlock the hatch 25, the handles 49 are rotated in the direction opposite to the locking direction and the hatch is removed. The ability to lock and unlock the hatch from both inside and outside the vessel is important since it assures that the last individual in the decompression chamber 11 can be transferred to the transfer vessel 13.

If a diver is injured, he is placed on a stretcher 44 and pushed into the transfer vessel 13. As shown in FIG. 1*a*, the stretcher 44 is provided with a frame 46 which slides along supports 45 in the transfer vessel 13.

In its most preferred form, the transfer chamber is manually transportable and capable of maintaining pressures of up to 335 pounds per square inch. It is cylindrically shaped and constructed from lightweight titanium alloy, preferably titanium 64, grade 5. Preferably the transfer chamber weighs between 500 and 600 pounds unmanned and most preferably approximately 550 pounds. The transfer chamber illustratively is approximately 91 inches long and 24 inches in diameter.

The shape and weight considerations are important in that they allow the transfer vessel to be moved easily in restricted surroundings such as those on an offshore rig. The cylindrical shape is also advantageous in that it allows ease of construction of the transfer chamber as well as providing a minimum number of seams to reduce the chances of seam failure and loss of pressure inside the transfer vessel. Furthermore, the cylindrical shape maximizes the space within the vessel for transporting individuals. The titanium 64, grade 5 alloy from which the chamber is preferably constructed is lightweight and able to withstand the high pressure. Construction of the chamber from titanium has the added advantage that the chamber is a poor conductor of heat and therefore heat within the transfer vessel is preserved. The transfer vessel 13 has a viewing porthole 24. The viewing porthole 24 is advantageous since it allows those outside the transfer chamber 13 to observe the condition of the divers within. The ability to view the divers through the porthole 24 also minimizes accidents which may occur from mistakenly opening the chamber when there are divers inside. Furthermore, the viewing porthole allows light to enter the transfer vessel thus providing a light source for those within. Additionally, the transfer vessel is supplied with its own oxygen supply 33 and compressed gas supply 37. Gas is supplied to the vessel 13 by attaching hoses 31 to mating fittings in penetrators 30 in box 29. The oxygen supply 33 and compressed gas supply 37 is advantageous in that it makes the transfer chamber self-sufficient by replacing the metabolic consumption of the divers and keeping constant pressure within thus preventing an injured diver's condition from deteriorating. The transfer vessel is also provided with a communication system 41 comprising an intercom system whereby the parties inside and outside the transfer chamber can apprise each other of any system malfunctions. Illustrative of a communication system used is Model 3204 for hyperbaric systems manufactured by Helle Engineering of San Diego, California.

The metal box 29 on top of the transfer vessel is welded to the vessel and protects the penetrators and instruments therein from damage by transmitting any shock to the vessel.

An oxygen sensor 39 is used to test the oxygen supply within the vessel 13. By wiring the sensor 39 to a female jack in a penetrator 30 in box 29, a meter having a male jack is plugged in to take a reading. Illustrative of such a sensor and meter is Unit 233R manufactured by Bio Marine Industries, Devon, Pennsylvania. The chamber has a small light bulb 43 which is wired to a 9 volt battery in box 29.

Referring to FIGS. 2 and 3, the transfer chamber 3 is carried using the handles 23 attached to the outside of the vessel 13. Alternatively, the vessel 13 can be transported by hooking the eye lifts 27 to a hook on a crane. The casters 21 are useful in pulling the transfer vessel 13 along flat surfaces. The casters 21 are mounted on adjustable screw jacks 19. The adjustable jacks 19 provide the advantage of allowing the transfer vessel to be mated easily with other chambers having hatches which are at various heights from the ground, since by adjusting each jack individually the operator can adjust the pitch, roll and yaw of the vessel as well as the height of the vessel 13.

The transfer vessel 13 is then brought together with a second chamber called a helicopter chamber 57, which has been brought to the required pressure either by using the gas system on the rig or its own tank system 77. If its own system is used, the tanks 77 are connected by hoses 79 to the control box 75 where the gas can be metered and passed into the chamber through hoses 81 and penetrators 30. The vessel 13 and chamber 57 are mated using the clamp-type coupling 15. The access hatch 25 of the transfer vessel 13 and the access door 69 of the helicopter chamber 57 are removed and the divers are transferred into the helicopter chamber 57. An attendant standing by in the chamber 57 may assist the divers from the transfer vessel 13 into the chamber 57. The helicopter chamber 57 is also provided with wheels 83 for ease of movement.

Referring to FIGS. 3, 4 and 6, if a diver is injured and on a stretcher in the transfer vessel 13, the transfer of the diver into the helicopter chamber 57 is accomplished by using a linear race ball bearing system 85. A related copending application filed concurrently herewith by Glenn J. Butler discloses a linear race ball bearing system used in hyperbaric chambers. The disclosure of the Butler application is hereby incorporated by reference. Illustrative of such a race ball bearing unit useable in this system is a linear race ball bearing unit made by Thompson Bearing Co. of Manhasset, New York. In its preferred form, a solid cylindrical rail 87 is mounted longitudinally on the inside of the helicopter chamber 21. The head 48 of the stretcher 44 is provided with a wire 97 connecting the two corners of the head of the stretcher to a ring 95 on the bearing cup 91. The bearing cup 91, with the channel shaped bearing race 93 within, is slideably mounted on the rail 87 by the attendant, already in the helicopter chamber 57. The ball bearings in the race 93 support the weight of the head of the stretcher 44 but also allow movement longitudinally along the rail into the helicopter chamber 57. The ends of a second wire 97 which passes through a ring 95 of a bearing cup 91 having a bearing race therein are attached to the corners of the foot 50 of the stretcher 44 and after pulling the stretcher 44 partially into the helicopter chamber 57, the second ball bearing race system 85 can be attached to the rail 87. Thus, the stretcher 44 can be pulled into the helicopter chamber 57 until the head of the stretcher 44 abuts the inside wall of the helicopter chamber 57. The cup and race are kept on the rail by inserting a disconnect pin 101 into each hole 99 on each end of the rail 87. After the stretcher 44 is inside the helicopter chamber 57 and secured by inserting the disconnect pins 101, two support brackets 127 which are attached to the inside of the chamber 57 are raised to support the weight of the stretcher 44. The brackets are also held in position by disconnect pins. At this point, the disconnect pins 101 in the rail 87 can be removed and each cup and race can be removed from each end of the rail 87. The access door 69 can then be resealed in the same manner that the hatch 25 is sealed.

When the helicopter chamber is full, it is ready to be transported to another hyperbaric facility by helicopter or another expedient means such as by boat or plane where conditions allow.

In a preferred embodiment, the helicopter chamber is a cylindrical chamber constructed from titanium 64, grade 5 alloy. The chamber is approximately 1750 pounds unmanned and can withstand pressures up to 335 psi. The chamber can accommodate up to eight individuals.

Use of a cylindrical shape and the titanium 64, grade 5 alloy are advantageous in that together they provide maximum wall strength and maximum space within the chamber while at the same time they provide a minimum number of seams and a minimum weight, all of which are desirable features in a helicopter chamber.

It is preferable that the helicopter chamber unmanned weigh between 1500 and 2600 pounds, more preferably about 1750 pounds.

During transportation, the helicopter chamber 57 is designed to provide a complete life support system. The main control panel 75 controls all monitoring devices and control systems except primary reduction of gas pressure. The control panel is also provided with spare connecting wires between the inside and outside of the chamber. These wires can be used as leads for various diagnostic devices which can be monitored outside the chamber. In addition to supplying gas for compression, the gas supply system 77 provides a breathing gas mixture and oxygen. The gas supply system 77 can be manually controlled from either inside or outside the helicopter chamber by providing hand operated valves both inside and outside the chamber 57.

A communication system 107 is provided which is identical to the system used in the transfer vessel 13.

A system for removing carbon dioxide 103 operable from within the chamber 57 is also provided. A system which can be used is a $CO_2$ Scrubber, Part Number Pura 707M 7A3SP made by Lindburg Hammer Co. of Mineral Wells, Texas. The unit operates by drawing the air within the chamber 57 through a cannister filled with "Sodasorb", a soda-lime mixture made by W. R. Grace & Co. of New York, New York.

The dehumidification system 105 can illustratively be a cannister type filled with 13X Linde Molecular Sieve made by Union Carbide. The dehumidification system and the carbon dioxide scrubber have the added advantage of providing heat to the helicopter chamber. The helicopter chamber 57 also contains an oxygen analysis system 109 using an oxygen sensor and analyzer. The oxygen sensor in the chamber 57 can be the same type used in the transfer vessel 13. In this manner, the oxygen analyzer can be used in both the chamber 57 and vessel 13. A carbon dioxide analysis system 111 in the chamber 57 is furnished, for example, by testing an air sample from one outlet port with a $CO_2$ tester such as Part No. CH 023501 made by Draeger-Multitube AG, Germany.

In addition to the heat provided by the $CO_2$ scrubber 103 and the dehumidification system 105, as well as the body heat provided by the divers within the chamber, heat within the chamber 57 is preserved by lining the chamber with one inch of foam insulation. Additionally eight heating strips 73 are secured to the outer surface of the chamber 37. Illustratively, the strips can be 55 Gallon Drum Heating Strips, Part No. BJDH 55-115 made by Briscoe Co. of Columbus, Ohio. An inside lighting system 83' within the chamber 57 is provided by a fiber optic system such as Model HYL80 made by J. M. Canty of Tonawanda, New York.

The medical lock 86 is important to the concept of life support in that it allows medical supplies, food, etc. to be passed into the chamber 57. A hand operated pressure release valve located in each closed end of the medical lock, allows the pressure in the lock 86 to be equalized before the lock is opened.

Power is supplied to the chamber by a pair of 12 volt batteries or by tapping into the helicopter's power supply.

Referring to FIG. 7, upon arrival at another hyperbaric facility 113, the helicopter chamber 57 is removed, brought into the facility and mated with the entry lock 115 of the hyperbaric facility 113 using a clamp-type coupling 15. Again the pressure in the hyperbaric facility 113 is made equal to the pressure in the helicopter chamber 57 and the access door 69 (not shown) is removed. The divers are then transferred into the main lock 119 of the hyperbaric facility 113 by passing through the entry lock 115 and passageway 117.

When there is an injured diver who must be carried out of the helicopter chamber 57 through the entry lock 115 and into the main lock 119, the linear race ball bearing system 85 (as shown in FIG. 6) is utilized to make the transfer.

A rod 123 bracketed to the top of facility 113 is extended through the entry lock 115 into the helicopter chamber 57. The rod 123 can be preferably a telescoping rod or it can be in a few separate sections which can be easily and quickly hung longitudinally on the ceiling of the hyperbaric facility 113.

In its preferred form, the rod 123 is a solid cylindrical rod of the same type as rail 87.

In order to transfer the stretcher 44 from the helicopter chamber 57, each cup 91 and race 93 at the head and foot of the stretcher 44 is reattached to the rail 87 by the attendant in the helicopter chamber 57. The rod 123 projects into the helicopter chamber 57. The stretcher 44 is pushed forward until the cup and race at the foot 50 of the stretcher 44 is at the end of the rail 87 at which time it is removed from the rail 87 and slid onto rod 123. The stretcher 44 is pushed forward towards the entry lock 115 until the cup and race at the head 48 of the stretcher 44 is at the end of the rail 87. The cup and race at the head of the stretcher is then removed from the rail 87 and slid into the rod 123. The stretcher 44, now completely supported by the rod 123, can be pulled through the entry lock 115 and into the main lock 119 within a few inches of a treatment table 125. At this point, attendants can disconnect the wires 97 and the injured diver can be transferred from the stretcher 44 to the table 125 using conventional bed-changing techniques.

The sliding rail system 85 serves the complete purpose of safely transferring a severely injured diver from the transfer vessel 13 into the helicopter chamber 57 and from the helicopter chamber to the hyperbaric facility 113. The system uses a minimal amount of structure thereby saving space in the already crowded chambers. Also the rail system allows the injured diver to be transferred easily through the hatch openings in the chambers. Without such a rail system, it would be very difficult for a single attendant inside helicopter chamber 57 to maneuver the injured diver in and out of the hatch opening. Additionally, the rail system allows the injured diver to be transferred into the main lock 119 of the hyperbaric facility 113 in a matter of seconds. The seconds saved using the rail system could save the diver's life.

The terms and expressions which have been employed are terms of description and not of limitation, and there is no intention in the use of such terms and expressions of excluding any equivalents of the features shown and described or portions thereof, but it is recognized that various modifications are possible within the scope of the invention claimed.

What is claimed is:

1. A hyperbaric system for transporting individuals comprising a first manually transportable hyperbaric chamber having an elliptical access opening and an elliptical access hatch to cover said opening, said elliptical access hatch being provided with means for selectively opening and closing the access hatch from both within and outside of said first hyperbaric chamber, said first chamber including a life-supporting system within said first chamber for a plurality of individuals;

a second transportable hyperbaric chamber weighing less than about 2600 pounds having an access aperture and an access door to cover said aperture, said second chamber including life-supporting means within said second chamber for at least three individuals; and means for coupling said access opening and said access aperture in a fluid tight relationship to permit movement of the individuals in said first chamber through said opening and said aperture into said second chamber when said access hatch and said access door are opened.

2. A hyperbaric system for transporting individuals comprising a first manually transportable hyperbaric chamber having an elliptical access opening and an elliptical access hatch to cover said opening, said elliptical access hatch being provided with means for selectively opening and closing the access hatch from both within and outside of said first hyperbaric chamber, said first chamber including life-supporting means within said first chamber for an individual; said life-supporting means comprising means other than through said access opening communicating with said first chamber for providing compression gas and oxygen therein;

a second transportable hyperbaric chamber weighing less than about 2600 pounds having an access aperture and an access door to cover said aperture, said second chamber including life-supporting means within said second chamber for at least three individuals; and means for coupling said access opening and said access aperture in a fluid tight relationship to permit movement of the individuals in said first chamber through said opening and said aperture into said second chamber when said access hatch and said access door are opened.

3. A hyperbaric system for transporting individuals comprising a first manually transportable hyperbaric chamber having an elliptical access opening and an elliptical access hatch to cover said opening, said elliptical access hatch being provided with means for selectively opening and closing the access hatch from both within and outside of said first hyperbaric chamber, said first chamber being cylindrical in shape;

a second transportable hyperbaric chamber weighing less than about 2600 pounds having an access aperture and an access door to cover said aperture, said chamber being cylindrical in shape, said second chamber including life-supporting means within said second chamber for at least three individuals; and means for coupling said access opening and said access aperture in a fluid tight relationship to permit movement of the individuals in said first chamber through said opening and said aperture into said second chamber when said access hatch and said access door are opened.

4. A hyperbaric system for transporting individuals comprising a first manually transportable hyperbaric chamber having an elliptical access opening and an elliptical access hatch to cover said opening, said elliptical access hatch being provided with means for selectively opening and closing the access hatch from both within and outside of said first hyperbaric chamber, said first chamber including life-supporting means within said first chamber for an individual; said life-supporting means comprising a stretcher and means permanently secured to the interior of the first chamber for slidably supporting the stretcher therein; and means other than through said access opening communicating with said first chamber for providing compression gas and oxygen therein;

a second transportable hyperbaric chamber weighing less than about 2600 pounds having an access aperture and an access door to cover said aperture, said second chamber including life-supporting means within said second chamber for at least three individuals, said second chamber being made substantially from a titanium alloy; and means for coupling said access opening and said access aperture in a fluid tight relationship to permit movement of the individuals in said first chamber through said opening and said aperture into said second chamber when said access hatch and said access door are opened.

5. A hyperbaric system for transporting individuals comprising a first manually transportable hyperbaric chamber having an elliptical access opening and an elliptical access hatch to cover said opening, said elliptical access hatch being provided with means for selectively opening and closing the access hatch from both within and outside of said first hyperbaric chamber;

a second transportable hyperbaric chamber weighing less than about 2600 pounds having an access aperture and an access door to cover said aperture, said second chamber including life-supporting means within said second chamber for a plurality of individuals, said life-support means comprising means communicating with said second chamber for providing breathing gas within said second chamber;

means communicating with said second chamber for supplementing the oxygen in the breathing gas supply supplied by said breathing gas means;

means operatively communicating with said second chamber for providing compression gas therein; and a plurality of sets of controls operatively associated with said second chamber for regulating said breathing, oxygen and compression gas in said second chamber, at least one of said sets of controls located outside of said second chamber and at least one of said sets located inside said second chamber; and means for coupling said access opening and said access aperture in a fluid tight relationship to permit movement of the individuals in said first chamber through said opening and said aperture into said second chamber when said access hatch and said access door are opened.

6. A hyperbaric system for transporting individuals comprising a first manually transportable hyperbaric chamber having an elliptical access opening and an elliptical access hatch to cover said opening said elliptical access hatch being provided with means for selectively opening and closing the access hatch from both within and outside of said first hyperbaric chamber, said first chamber being made substantially from a titanium alloy;

a second transportable hyperbaric chamber weighing less than about 2600 pounds having an access aperture and an access door to cover said aperture, said chamber being made substantially from a titanium alloy, said second chamber including life-supporting means within said second chamber for a plurality of individuals; and means for coupling said access opening and said access aperture in a fluid tight relationship to permit movement of the individuals in said first chamber through said opening and said aperture into said second chamber when said access hatch and said access door are opened.

7. A hyperbaric system as claimed in claim 6, wherein the titanium alloy is titanium 64, grade 5.

8. A hyperbaric system for transporting individuals comprising a first manually transportable hyperbaric chamber having an elliptical access opening and an elliptical access hatch to cover said opening, said elliptical access hatch being provided with means for selectively opening and closing the access hatch from both within and outside of said first hyperbaric chamber, said first chamber being cylindrical in shape, and made substantially from a titanium alloy, said first chamber including life-supporting means within said first chamber for an individual; said life-supporting means comprising a stretcher and means permanently secured to the interior of the first chamber for slidably supporting the stretcher therein; and means other than through said access opening communicating with said first chamber for providing compression gas and oxygen therein;

a second transportable hyperbaric chamber weighing less than about 2600 pounds having an access aperture and an access door to cover said aperture, said chamber being cylindrical in shape, and made substantially from a titanium alloy, said second chamber including life-supporting means within said second chamber for a plurality of individuals; said life-supporting means comprising means mounted within said second chamber for removing $CO_2$ therefrom;

means communicating with said second chamber for providing breathing gas within said second chamber;

means communicating with said second chamber for supplementing the oxygen in the breathing gas supply supplied by said breathing gas means;

means operatively communicating with said second chamber for providing compression gas therein; and means mounted within said second chamber for dehumidifying the inside of said second chamber; and means for coupling said access opening and said access aperture in a fluid tight relationship to permit movement of the individuals in said first chamber through said opening and aperture into said second chamber when said access hatch and said access door are opened.

9. The hyperbaric system as claimed in claim 8, wherein said life-support means in said second chamber further includes testing means operatively associated with said second chamber for analyzing oxygen and carbon dioxide content therein.

10. The hyperbaric system, as claimed in claim 8, wherein said life-support means in said second chamber further includes means controllably associated with said second chamber for providing heat therein.

11. The hyperbaric system as claimed in claim 8, wherein said life-support means in said second chamber further includes means mounted in said second chamber for transferring materials into and out of said second chamber.

12. A hyperbaric system for transporting individuals comprising a first manually transportable hyperbaric chamber having an elliptical access opening and a removable elliptical access hatch to cover said opening, said elliptical access hatch being provided with means for selectively opening and closing the access hatch from both within and outside of said first hyperbaric chamber, said first chamber including life-supporting means within said first chamber for an individual;

a second transportable hyperbaric chamber weighing less than about 2600 pounds having an access aperture and an access door to cover said aperture, said second chamber including life-supporting means within said second chamber for a plurality of individuals;

a plurality of sets of control for said life-supporting means, at least one of said sets being operable from inside of the second chamber and at least one of said sets being operable from outside of said second chamber; and means for coupling said access opening and said access aperture in a fluid tight relationship to permit movement of the individuals in said first chamber through said opening and said aperture into said second chamber when said access hatch and said access door are opened.

13. A hyperbaric system for transporting individuals comprising a first manually transportable hyperbaric chamber having an elliptical access opening and an elliptical access hatch to cover said opening, said elliptical access hatch being provided with means for selectively opening and closing the access hatch from both within and outside of said first hyperbaric chamber;

a second transportable hyperbaric chamber weighing less than about 2600 pounds having an access aperture and an access door to cover said aperture, said chamber being cylindrical in shape, having a viewing window therein, and made substantially from a titanium alloy, said second chamber including life-supporting means within said second chamber for at least three individuals; said life-supporting means comprising system mounted within said second chamber for removing $CO_2$ therefrom;

means communicating with said second chamber for providing breathing gas within said second chamber;

means communicating with said second chamber for supplementing the oxygen in the breathing gas supply supplied by said breathing gas means;

means operatively communicating with said second chamber for providing compression gas therein;

system mounted within said second chamber for dehumidifying the inside of said second chamber; and testing means operatively associated with said second chamber for analyzing oxygen and carbon dioxide content therein; and means for coupling said access opening and said access aperture in a fluid tight relationship to permit movement of the individuals in said first chamber through said opening and said aperture into said second chamber when said access hatch and said access door are opened.

14. The hyperbaric system as claimed in claim 13, wherein said life support means in said second chamber further includes a communication system operatively connected to said second chamber for communication from outside said second chamber with the individuals therein.

15. The hyperbaric system as claimed in claim 13, wherein said life support means in said second chamber further includes means controllably associated with said second chamber for providing heat therein.

16. The hyperbaric system as claimed in claim 13, wherein said life support means in said second chamber further includes a fiber optic lighting system for providing light within said second chamber, said system operatively connected to said second chamber.

17. The hyperbaric system as claimed in claim 13, wherein said life support means in said second chamber further includes means mounted in said second chamber for transferring materials into and out of said second chamber.

18. The hyperbaric system for transporting individuals comprising a first manually transportable hyperbaric chamber having an elliptical access opening and a removable elliptical access hatch to cover said opening, said first chamber having a plurality of rolling means mounted thereon to assist movement of said first chamber, said first chamber being cylindrical in shape, having a viewing porthole therein, and made substantially from a titanium alloy, said first chamber including life-supporting means within said first chamber for a plurality of individuals; said life-supporting means comprising a communication system operatively connected to said first chamber for communication from outside said first chamber with said individuals therein;

a stretcher and means permanently secured to the interior of the first chamber for slidably supporting the stretcher therein; and means communicating with said first chamber for providing compression gas and oxygen therein;

a second transportable hyperbaric chamber weighing less than about 2600 pounds having an access aperture and an access door to cover said aperture, said chamber being cylindrical in shape, having a viewing window therein, and made substantially from a titanium alloy, said second chamber including life-supporting means within said second chamber for at least three individuals; said life-supporting means comprising system mounted within said second chamber for removing $CO_2$ therefrom;

means communicating with said second chamber for providing breathing gas within said second chamber;

means communicating with said second chamber for supplementing the oxygen in the breathing gas supply supplied by said breathing gas means;

means operatively communicating with said second chamber for providing compression gas therein;

a plurality of sets of controls operatively associated with said second chamber for regulating said breathing, oxygen and compression gas in said second chamber, at least one of said sets of controls located outside of said second chamber and at least one of said sets located inside said second chamber;

system mounted within said second chamber for dehumidifying the inside of said second chamber;

testing means operatively associated with said second chamber for analyzing oxygen and carbon dioxide content therein;

a communication system operatively connected to said second chamber for communication from outside said second chamber with the individuals therein;

means controllably associated with said second chamber for providing heat therein;

a fiber optic lighting system for providing light within said second chamber, said system operatively connected to said second chamber; and means mounted in said second chamber for transferring materials into and out of said second chamber; and means for coupling said access opening and said access aperture in a fluid tight relationship to permit movement of the individuals in said first chamber through said opening and said aperture into said second chamber when said access hatch and said access door are opened.

19. A hyperbaric system for transporting individuals comprising a first manually transportable hyperbaric chamber having an elliptical access opening and a removable elliptical access hatch to cover said opening, said first chamber having rolling means mounted thereon to assist movement of said first chamber, said first chamber being cylindrical in shape, having a viewing porthole therein, and made substantially from a titanium alloy, said first chamber including life-supporting means within said first chamber for up to two individuals; said life-supporting means comprising a communication system operatively connected to said first chamber for communication from outside said first chamber with said individuals therein;

a stretcher and means permanently secured to the interior of the first chamber for slidably supporting the stretcher therein; and means communicating with said first chamber for providing compression gas and oxygen therein;

a second transportable hyperbaric chamber weighing less than about 2600 pounds having an access aperture and an access door to cover said aperture, said chamber being cylindrical in shape, having a viewing window therein, and made substantially from a titanium alloy, said second chamber including life-supporting means within said second chamber for at least three individuals; said life-supporting means comprising system mounted within said second chamber for removing $CO_2$ therefrom;

means communicating with said second chamber for providing breathing gas within said second chamber;

means communicating with said second chamber for supplementing the oxygen in the breathing gas supply supplied by said breathing gas means;

means operatively communicating with said second chamber for providing compression gas therein;

a plurality of sets of controls operatively associated with said second chamber for regulating said breathing, oxygen and compression gas in said second chamber, at least one of said sets of controls located outside of said second chamber and at least one of said sets located inside said second chamber;

system mounted within said second chamber for dehumidifying the inside of said second chamber;

testing means operatively associated with said second chamber for analyzing oxygen and carbon dioxide content therein;

a communication system operatively connected to said second chamber for communication from outside said second chamber with the individuals therein;

means controllably associated with said second chamber for providing heat therein;

a fiber optic lighting system for providing light within said second chamber, said system operatively connected to said second chamber; and means mounted in said second chamber for transferring materials into and out of said second chamber; and means for coupling said access opening and said access aperture in a fluid tight relationship to permit movement of the individuals in said first chamber though said opening and said aperture into said second chamber when said access hatch and said access door are opened.

20. The hyperbaric system as claimed in claim 12; wherein said first chamber is substantially cylindrical in shape and made substantially from a titanium alloy and said life-supporting means comprising a stretcher and means permanently secured to the interior of the first chamber for slidably supporting the stretcher therein; and means other than through said access opening communicating with said first chamber for providing compression gas and oxygen therein.

21. The hyperbaric system as claimed in claim 20, wherein said life support means in said first chamber further includes a communication system operatively connected to said first chamber for communication from outside said first chamber with said individual therein.

22. A hyperbaric system for transporting individuals comprising a first manually transportable hyperbaric chamber having an elliptical access opening and an elliptical access hatch to cover said opening, said elliptical access hatch being provided with means for selectively opening and closing the access hatch from both within and outside of said first hyperbaric chamber said first chamber including a life-supporting system within said first chamber for an individual;

a second transportable hyperbaric chamber weighing less than about 2600 pounds having an access aperture and an access door to cover said aperture, said second chamber including life-supporting means within said second chamber for a plurality of individuals; and means for coupling said access opening and said access aperture in a fluid tight relationship to permit movement of the individuals in said first chamber through said opening and said aperture into said second chamber when said access hatch and said access door are opened.

* * * * *